US007479063B2

(12) United States Patent
Pryzby et al.

(10) Patent No.: US 7,479,063 B2
(45) Date of Patent: Jan. 20, 2009

(54) AUDIO NETWORK FOR GAMING MACHINES

(75) Inventors: Eric M. Pryzby, Skokie, IL (US); Rory L. Block, Carson City, NV (US)

(73) Assignee: WMS Gaming Inc., Waukegan, IL (US)

( * ) Notice: Subject to any disclaimer, the term of this patent is extended or adjusted under 35 U.S.C. 154(b) by 835 days.

(21) Appl. No.: 10/955,664

(22) Filed: Sep. 30, 2004

(65) Prior Publication Data

US 2005/0043090 A1 Feb. 24, 2005

Related U.S. Application Data

(63) Continuation-in-part of application No. 10/342,817, filed on Jan. 16, 2003, which is a continuation-in-part of application No. 09/679,093, filed on Oct. 4, 2000, now Pat. No. 6,939,226.

(51) Int. Cl.
*A63F 9/24* (2006.01)

(52) U.S. Cl. ..... 463/35

(58) Field of Classification Search ..... None
See application file for complete search history.

(56) References Cited

U.S. PATENT DOCUMENTS

| | | | | |
|---|---|---|---|---|
| 3,533,629 A | | 10/1970 | Raven | 463/18 |
| 4,522,399 A | | 6/1985 | Nishikawa | 273/143 R |
| 5,133,017 A | | 7/1992 | Cain et al. | 381/71 |
| 5,259,613 A | * | 11/1993 | Marnell, II | 463/42 |
| 5,318,298 A | | 6/1994 | Kelly et al. | 273/122 R |
| 5,370,399 A | | 12/1994 | Liverance | 273/434 |
| 5,444,786 A | | 8/1995 | Raviv | 381/71 |
| 5,469,510 A | | 11/1995 | Blind et al. | 381/55 |

(Continued)

FOREIGN PATENT DOCUMENTS

AU 199943487 3/2000

(Continued)

OTHER PUBLICATIONS

European Search Report for European Patent Application No. EP 04 00 0865, dated Oct. 6, 2004 (3 pages).

(Continued)

*Primary Examiner*—Robert E. Pezzuto
*Assistant Examiner*—O. Deodhar
(74) *Attorney, Agent, or Firm*—Nixon Peabody LLP

(57) ABSTRACT

A gaming machine network includes a plurality of gaming machines and a central controller. Each gaming machine further includes an associated peripheral device electronically coupled to the gaming machine. The peripheral device includes an audio speaker system broadcasting an audio output to a player of the gaming machine. The central controller is electronically coupled to each of the plurality of gaming machines and sends audio instructions for controlling the audio outputs from the audio speaker systems within the peripheral devices. Alternatively, or in addition to the aforementioned operation, the central controller may receive audio instructions from the peripheral device associated with one of the gaming machines and the central controller further transmits the audio instructions to selected other ones of the plurality of gaming machines. The peripheral device may be, for example, a top box for the gaming machine or a contoured chair for the gaming machine.

56 Claims, 5 Drawing Sheets

U.S. PATENT DOCUMENTS

| | | | | |
|---|---|---|---|---|
| 5,524,888 | A | 6/1996 | Heidel | 43/21 |
| 5,533,727 | A | 7/1996 | DeMar | 463/23 |
| 5,542,669 | A | 8/1996 | Charron et al. | 463/13 |
| 5,655,961 | A | 8/1997 | Acres et al. | 463/27 |
| 5,695,188 | A | 12/1997 | Ishibashi | 273/143 R |
| 5,743,798 | A | 4/1998 | Adams et al. | 463/17 |
| 5,762,552 | A | 6/1998 | Vuong et al. | 463/25 |
| 5,775,993 | A | 7/1998 | Fentz et al. | 463/17 |
| 5,807,177 | A * | 9/1998 | Takemoto et al. | 463/47 |
| 5,816,918 | A | 10/1998 | Kelly et al. | 463/16 |
| 5,828,768 | A | 10/1998 | Eatwell et al. | 381/333 |
| 5,833,538 | A | 11/1998 | Weiss | 463/21 |
| 5,851,148 | A | 12/1998 | Brune et al. | 463/25 |
| 5,941,773 | A | 8/1999 | Harvel | 463/16 |
| 5,971,850 | A | 10/1999 | Liverance | 463/23 |
| 6,068,552 | A | 5/2000 | Walker et al. | 463/21 |
| 6,089,663 | A | 7/2000 | Hill | 297/258.1 |
| 6,110,041 | A | 8/2000 | Walker et al. | 463/20 |
| 6,162,121 | A | 12/2000 | Morro et al. | 463/16 |
| 6,217,448 | B1 | 4/2001 | Olsen | 463/25 |
| 6,254,483 | B1 * | 7/2001 | Acres | 463/26 |
| 6,302,790 | B1 | 10/2001 | Brossard | 463/20 |
| 6,308,953 | B1 | 10/2001 | Nagano | 273/143 R |
| 6,315,666 | B1 | 11/2001 | Mastera et al. | 463/31 |
| 6,416,411 | B1 | 7/2002 | Tsukahara | 463/35 |
| 6,422,941 | B1 | 7/2002 | Thorner et al. | 463/30 |
| 6,471,589 | B1 | 10/2002 | Nagano | 463/21 |
| 6,530,842 | B1 | 3/2003 | Wells et al. | 463/46 |
| 6,561,908 | B1 | 5/2003 | Hoke | 463/35 |
| 6,564,108 | B1 * | 5/2003 | Makar et al. | 700/17 |
| 6,638,169 | B2 | 10/2003 | Wilder et al. | 463/35 |
| 6,676,514 | B1 | 1/2004 | Kusuda et al. | 463/24 |
| 2002/0037763 | A1 | 3/2002 | Idaka | 463/16 |
| 2002/0039919 | A1 | 4/2002 | Joshi et al. | 463/20 |
| 2002/0090990 | A1 | 7/2002 | Joshi et al. | 463/20 |
| 2002/0142825 | A1 | 10/2002 | Lark et al. | 463/16 |
| 2002/0142846 | A1 | 10/2002 | Paulsen | 463/43 |
| 2002/0151349 | A1 | 10/2002 | Joshi | 463/20 |
| 2002/0160826 | A1 * | 10/2002 | Gomez et al. | 463/16 |
| 2003/0054881 | A1 | 3/2003 | Hedrick et al. | 463/29 |
| 2003/0114214 | A1 | 6/2003 | Barahona et al. | 463/20 |
| 2004/0029637 | A1 | 2/2004 | Hein, Jr. et al. | 463/35 |

FOREIGN PATENT DOCUMENTS

| | | | |
|---|---|---|---|
| EP | 0981 119 | A2 | 2/2000 |
| JP | 5-31254 | | 2/1993 |
| JP | 10-277213 | | 10/1998 |
| WO | 0977 856 | | 12/1998 |
| WO | WO 01/05477 | A2 | 1/2001 |
| WO | WO 01/05477 | A3 | 1/2001 |
| WO | WO 01/33905 | A2 | 5/2001 |
| WO | WO 10/39905 | A3 | 5/2001 |
| WO | WO 02/24288 | A2 | 3/2002 |
| WO | WO 02/24288 | A3 | 3/2002 |
| WO | WO 02/40921 | A3 | 5/2002 |
| WO | WO 2005/026883 | A2 | 3/2005 |
| WO | WO 2005/027059 | A2 | 3/2005 |

OTHER PUBLICATIONS

European Search Report for European Patent Application No. EP 04 00 0730, dated Oct. 11, 2004 (5 pages).

European Search Report for European Patent Application No. EP 04 00 3314, dated Oct. 13, 2004 (3 pages).

European Search Report for European Patent Application No. EP 04 00 0731, dated Oct. 14, 2004 (3 pages).

Weint, Joe, Entertainment Vehicles, IGWB New '97 Games, Mar. 1997, pp. 11-12, 15-18.

* cited by examiner

AUDIO NETWORK FOR GAMING MACHINES

RELATED APPLICATIONS

This application is a continuation-in-part of U.S. patent application Ser. No. 10/342,817, filed Jan. 16, 2003, which is a continuation-in-part of U.S. patent application Ser. No. 09/679,093, filed Oct. 4, 2000, U.S. Pat. No. 6,939,226 both of which are incorporated herein by reference in their entireties.

FIELD OF THE INVENTION

The present invention relates generally to gaming machines and, more particularly, to a gaming machine and a gaming machine network having an enhanced audio output.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Consequently, shrewd operators strive to employ the most entertaining and exciting machines available because such machines attract frequent play and, hence, increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is that of a "secondary" or "bonus" game which may be played in conjunction with a "basic" game. The bonus game may comprise any type of game, either similar to or completely different from the basic game, which is entered upon the occurrence of a selected event or outcome of the basic game. Such a bonus game produces a significantly higher level of player excitement than the basic game because it provides a greater expectation of winning than the basic game and is accompanied by more attractive or unusual video displays and/or audio.

Most types of enhancement, however, have focused primarily on visual effects. For example, gaming machines may included various types of displays for displaying different images in an "attract mode" to stir interest in players. And, the visual effects of the game features, such as reels and symbols, have been changed to be more attractive.

While these player-appeal features provide some enhanced excitement relative to other known games, there is a continuing need to develop new features for gaming machines to satisfy the demands of players and operators. Preferably, such new features will further enhance the level of player excitement. The present invention is directed to satisfying these needs.

SUMMARY OF THE INVENTION

To satisfy the aforementioned needs, a gaming machine network includes a plurality of gaming machines and a central controller. Each gaming machine of the plurality of gaming machines includes a display for displaying a randomly selected outcome of a plurality of outcomes of the gaming machine in response to a wager input for a player. Each gaming machine further includes an associated peripheral device electronically coupled to the gaming machine. The peripheral device includes an audio speaker system broadcasting an audio output to a player of the gaming machine. The central controller is electronically coupled to each of the plurality of gaming machines and sends audio instructions for controlling the audio outputs from the audio speaker systems within the peripheral devices of the plurality of gaming machines. Alternatively, or in addition to the aforementioned operation, the central controller may receive audio instructions from the peripheral device associated with one of the gaming machines and the central controller further disseminates the audio instructions to selected other ones of the plurality of gaming machines. The peripheral device may be, for example, a top box for the gaming machine, in which a bonus game or progressive game is displayed. Or, the peripheral device can be a chair for the gaming machine.

In an alternative embodiment, a gaming machine network includes a plurality of gaming machines, signage located proximate to the gaming machines, and a central controller. Each gaming machine of the plurality of gaming machines includes a display for displaying a randomly selected outcome of a plurality of outcomes of the gaming machine in response to a wager input. The signage is electronically coupled to the gaming machines and includes an audio speaker system broadcasting an audio output to players of the gaming machines. A memory device in the signage contains audio files. The central controller is electronically coupled to each of the plurality of gaming machines and the signage. The central controller receives audio instructions from the signage and disseminates the audio instructions to selected ones the plurality of gaming machines. Alternatively, or in addition to the aforementioned operation, the central controller receives audio instructions from one of the plurality of gaming machines and disseminates the audio instructions to the signage.

The present invention also contemplates novel methods for selectively controlling audio outputs of peripheral devices and signage that are associated with the gaming machines. The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
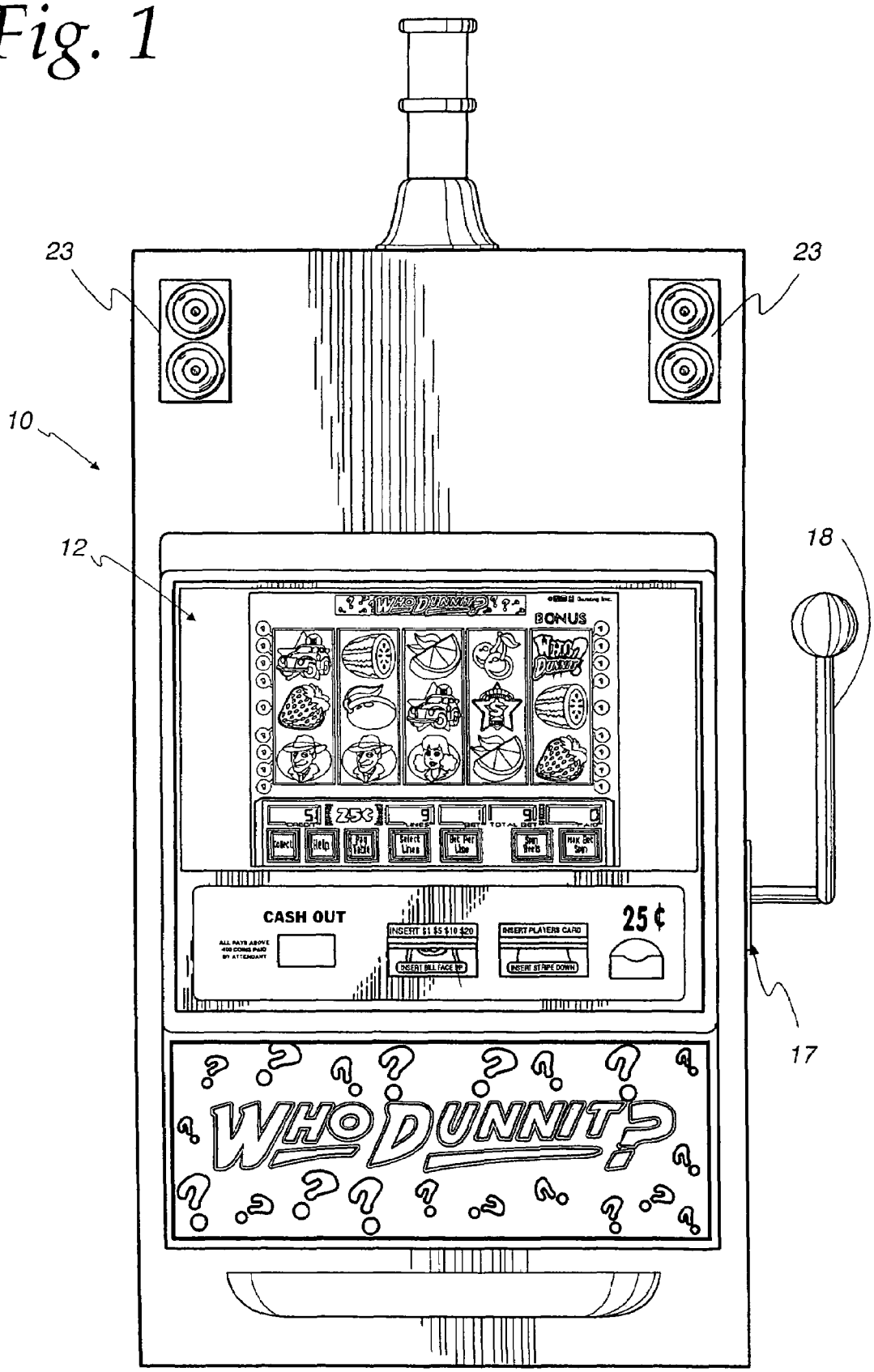
FIG. 1 is a simplified front view of a slot machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings and referring initially to FIG. 1, a video gaming machine 10 is depicted that may be used to implement a bonus game according to the present invention. The gaming machine 10 includes a video display 12 that may comprise a dot matrix, CRT, LED, LCD, electro-luminescent display, or generally any type of video display known in the art. In the illustrated embodiment, the gaming machine 10 is an "upright" version in which the video display 12 includes a touch screen and is oriented vertically relative to the player. It will be appreciated, however, that any of several other models of gaming machines are within the scope of the present invention, including, for example, a "slant-top" version in which the video display is slanted at about a 30° angle toward the player, or gaming machines that include mechanical, rather than video, displays.

In one embodiment, the gaming machine 10 is operable to play a game entitled WHO DUNNIT?™ having a mystery theme. The WHO DUNNIT?™ game features a basic game in the form of a slot machine with five simulated spinning reels and a bonus game with strategy options directing game activities on the video display 12. It will be appreciated, however, that the gaming machine 10 may be implemented with games other than the WHO DUNNIT?™ game and/or with several alternative game themes.

Figure 2A:
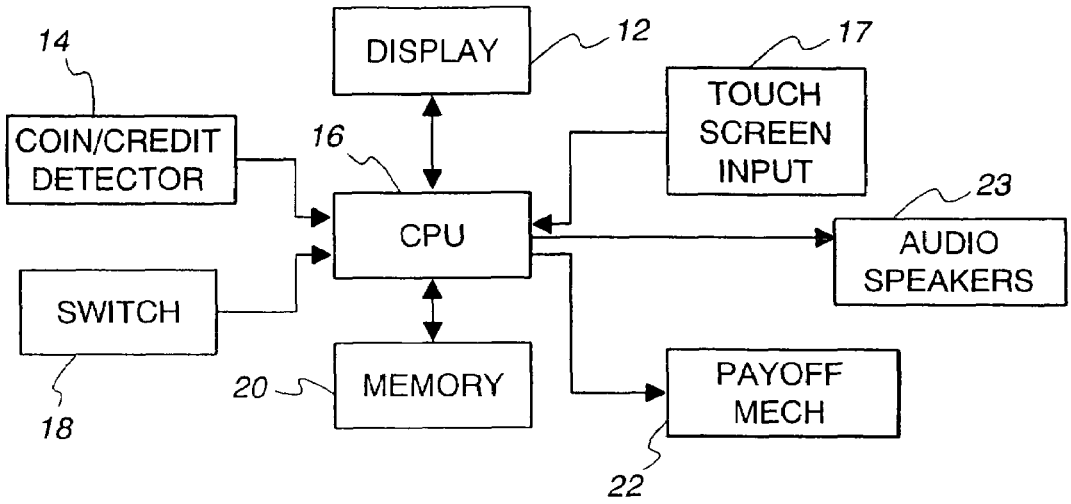
FIG. 2A is a block diagram of a control system suitable for operating the gaming machine in FIG. 1.

FIG. 2A is a block diagram of a control system suitable for operating the gaming machine 10. Coin/credit detector 14 signals a CPU 16 when a player has inserted a number of coins or played a number of credits. Then, the CPU 16 executes a game program which causes the video display 12 to display the basic game that includes simulated reels with symbols displayed thereon. The player may select the number of paylines to play and the amount to wager via touch screen input keys 17. The basic game commences in response to the player activating a switch 18 in a lever or push button, causing the CPU 16 to set the reels in motion, randomly select a game outcome, and then stop the reels to display symbols corresponding to the pre-selected game outcome. In one embodiment, certain basic game outcomes cause the CPU 16 to enter a bonus mode, which causes the video display 12 to show a bonus game, as is known in the art.

A system memory 20 stores control software, operational instructions, and data associated with the gaming machine 10. In one embodiment, the system memory 20 comprises a separate read-only memory (ROM) and battery-backed random-access memory (RAM). It will be appreciated, however, that the system memory 20 may be implemented on any of several alternative types of memory structures or may be implemented on a single memory structure. A payoff mechanism 22 is operable in response to instructions from the CPU 16 to award a payoff of coins or credits to the player in response to certain winning outcomes which may occur in the basic game or bonus game. The payoff amounts corresponding to certain combinations of symbols in the basic game are predetermined according to a pay table stored in system memory 20. The payoff amounts corresponding to certain outcomes of the bonus game are also stored in system memory 20.

As shown in FIGS. 1 and 2A, the gaming machine 10 also includes audio speakers 23 for broadcasting audio output to the player of the game and other spectators adjacent the game. The audio output may include various outputs, such as messages related to the game being played, messages unrelated to the game, a certain type of music (e.g., rock, classical, jazz, etc.), or music related to a theme of a game. The audio speakers 23 are usually located on the front portion of the cabinet and include just one speaker or a plurality of audio speakers 23. The speakers 23 may be arranged in a planar along the front of the gaming machine, or they can be positioned in a non-planar fashion around the player of the game. In a further alternative, the speakers 23 may be configured to deliver surround sound to the player.

In the basic system configuration, the gaming machine 10 stores a plurality of audio data sets in the memory 20. The CPU 16 then selects the audio data set that is processed for broadcasting the selected audio output to the speakers 23. The CPU 16 can do so in response to certain events, some of which are discussed below with respect to FIGS. 3 and 4. Preferably, the audio data sets are stored in a digital format. As such, the gaming machine 10 must include components and circuitry for converting the digital data to analog audio signals and amplifying those analog signals to produce an output from the speakers 23. In one preferred embodiment, the audio data is stored in a surround-sound format for broadcasting a surround-sound audio output from a plurality of surround speakers 23 spatially arranged around the gaming machine 10.

Figure 2B:
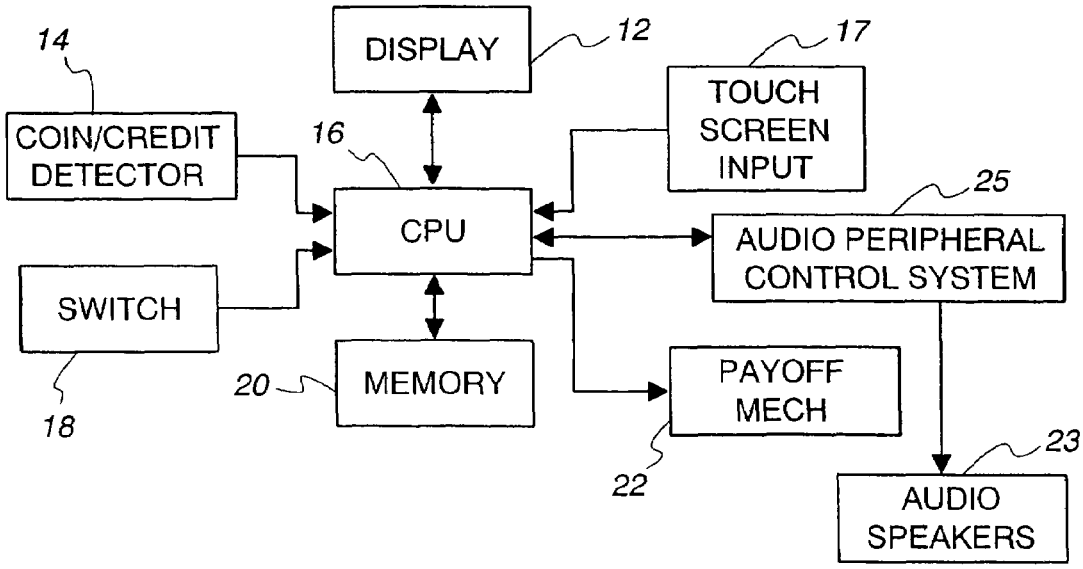
FIG. 2B is an alternative block diagram to FIG. 2A illustrating a gaming machine having an audio peripheral control system coupled to the main CPU.

FIG. 2B illustrates an alternative control system that is different from FIG. 2A in that it has a distinct audio peripheral control system 25 for controlling the audio output from the speakers 23. The audio peripheral control system 25 preferably has its own controller or microprocessor that has access to its own audio memory device that stores the audio data sets. Further, the audio peripheral control system 25 has the A/D converters, amplifiers, and other drive circuitry necessary to broadcast the audio output from the speakers 23. In short, the control system of FIG. 2B allows for all of the audio signal processing to occur on a peripheral device, thereby allowing for a more sophisticated audio experience without overburdening the CPU 16 and the memory 20 of the gaming machine 10.

Figure 3:
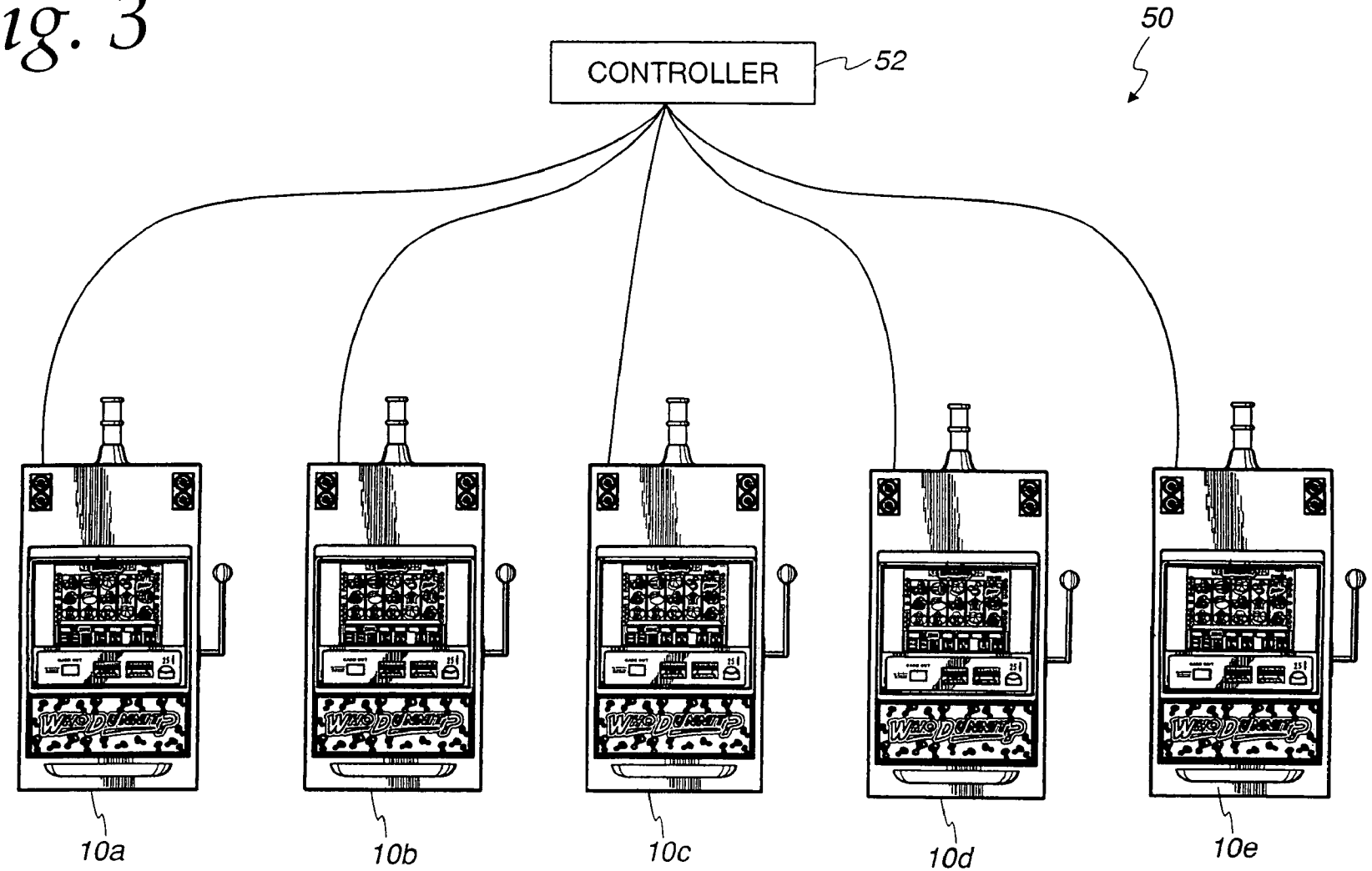
FIG. 3 illustrates one embodiment of a gaming system architecture in which a bank of gaming machines are connected to a central controller.

Referring now to FIG. 3, a gaming machine system architecture 50 is illustrated that includes a central controller 52 that is linked to a plurality of gaming machines 10*a*-10*e*. The system architecture allows for various aspects of the gaming machines 10*a*-10*e*, such as the audio elements of the game (i.e., audio outputs), to be controlled by an external device which, in this case, is the controller 52. For example, when the real time is a predetermined time, the central controller 52 can send audio instructions to the gaming machines 10*a*-10*e* that cause each gaming machine 10*a*-10*e* to select a certain audio data set that is used for broadcasting a certain audio output. This predetermined time can be a certain time of a day, a certain day of the week, or a certain day of a year. For example, the audio instructions having a holiday-specific theme can be transmitted from the controller 52 to the gaming machines 10*a*-10*e* on certain holidays, such as Valentine's Day, St. Patrick's Day, Mardi Gras, Easter, the 4$^{th}$ of July, Halloween, Thanksgiving, Christmas, New Year's Eve, and New Year's Day.

In another example of controlling the audio output, the system architecture 50 is useful for determining which type of audio outputs or other types of player appeal features are the favorite among players. In the system architecture 50, the wager inputs for each of the plurality of gaming machines 10*a*-10*e* are monitored by the controller 52. The controller 52 may intermittently download information on the wager inputs at selected times or continuously download information for real time updates. A correlation exists between the favorite audio outputs, or other player appeal features, and the total amount of wager inputs for the associated machine on which the audio outputs are broadcast. When the controller 52 determines that a particular player appeal feature is the favorite of players, it then takes the necessary steps to inform a particular one of the gaming machines 10*a*-10*e*, which is not displaying or broadcasting the favorite audio output, to begin playing the favorite audio output. In other words, the amount of wager input to each machine is a feedback mechanism by which the controller 52 determines which of the audio elements and/or other player appeal features is the favorite, thereby causing that favorite to be broadcast more frequently on other machines 10*a*-10*e*. For example, the favorite visual element or audio element may be displayed for more than 75% of any day or 75% of any week.

In addition to the feedback mechanism described above with reference to FIG. 3, the internal controller (e.g., CPU 16 in FIG. 2) of one particular gaming machine 10 may monitor the wager inputs for that machine while different audio elements are being broadcast (or other player appeal features are being displayed/broadcast) so that the controller internally determines which of the audio outputs are the most appealing to the players. Once the favorite of the players is determined, the internal controller for the gaming machine 10 begins to play that player appeal feature more frequently. Because the amount of wager inputs is also a function of the number of people in the casino, which is a function of the day and the time of day, the controller of the internal machine or the controller 52 of the system architecture 50 of FIG. 3 may monitor wager inputs over a longer period of time, such as a week, in order to determine which of the player appeal features is the favorite.

Further, the gaming machine 10 or the system architecture 50 of FIG. 3 may determine the types of audio outputs that are the favorites at certain times of the day or on certain days of the week. This is due to the demographics of individuals entering the casino on certain days and at certain hours of the evening. Accordingly, knowing that a demographic group is most prevalent on Friday nights and Saturday nights, the gaming machine 10 and the system architecture 50 of FIG. 3 may act to determine the favorites on Friday nights and Saturday nights and broadcast those audio output favorites more on those nights than on other nights. Alternatively, a second demographic group may be more prevalent during the weekdays from 8:00 AM until 4:00 PM. Thus, the gaming machine 10 and the system architecture 50 of FIG. 3 may act to determine the favorites for this second demographic group and display those favorites at those hours.

In addition to the aforementioned time-based controlling of the audio output or the favorite-based controlling of the audio output, the controller 52 may selectively control the audio output of the gaming machines 10*a*-10*e* based on other triggering events. For example, if the first gaming machine 10*a* achieves a highly desired outcome, a corresponding signal indicative of the outcome can be transmitted to the controller 52, causing the controller 52 to send certain audio instructions to the gaming machine 10*a* to cause an audio output indicative of the outcome. This could be a message commending the player on the outstanding outcome or a message regarding the location in a casino at which the player shall receive the payout from casino personnel. The audio instructions could be in the form of instructions that cause the gaming machine 10*a* to play certain music, for example, the song "We Are The Champions" by the musical group Queen. Such music is indicative of the game outcome. Or, music that lacks lyrics indicative of the game outcome, but which is fast and upbeat could be broadcast from the gaming machine 10*a* after the desired game outcome is achieved.

A triggering event also includes a specific request by the player for a certain type of audio output, which may be accomplished by actuating certain I/O devices on the gaming machine 10. The triggering event may be a randomly chosen event or time as well. In short, the triggering events may result in the interruption of a first audio output, followed by the broadcasting of a second audio output.

In addition, the central controller 52 upon receipt of such a signal from the first gaming machine 10*a* can also cause certain audio outputs to be broadcast from the other gaming machines 10*b*-10*d* in the gaming machine bank, or only on the adjacent gaming machine 10*b*. In other words, the game outcome of one gaming machine 10*a*-10*e* can result in selected audio output being broadcast from one or more of the other gaming machines 10*a*-10*e*.

The central controller 52 may send different audio instructions to the different gaming machines 10*a*-10*e*. For example, each gaming machine 10*a*-10*e* may be instructed to broadcast a song from its speakers, but with different acoustical characteristics corresponding to different musical instruments. Or, if the gaming machine 10*c* has a winning outcome, audio instructions may be sent to gaming machine 10*d* which results in the audible message, "the player on your left is REAL happy" while audio instructions may be sent to gaming machine 10*b* which results in the audible message, "the player on your right is SUPER happy." As another example, the gaming machines 10*a*-10*e* may be used to sequentially tell a message to the entire gaming area or room by each of them stating one word or a few words of a sentence, such as, "these gaming machines are just giving away money tonight!" Further, the central controller 52 can selectively control the broadcast of all of the speakers of the gaming machines 10*a*-10*e* to create a surround sound effect for the players of the gaming machines 10*a*-10*e*. Thus, by selectively controlling the audio outputs of each of the gaming machines 10*a*-10*e*, choreographed audio effects for the overall bank of gaming machines 10*a*-10*e* can be achieved In any of these embodiments where the controller 52 is controlling the audio output, the gaming machines 10*a*-10*e* may have a library of known audio data sets that are stored in a local memory device, such as memory device 20 (FIG. 2A) or a memory device associated with an audio peripheral control system 25 (FIG. 2B). Alternatively, the gaming machines 10*a*-10*e* can each access a remote memory device that is linked in the network of the system architecture 50.

In yet a further embodiment, the system architecture 50 and the controller 52 are structured and configured to transmit audio instructions that contain the audio data. Thus, the gaming machines 10*a*-10*e* do not need to store the audio data sets in a memory device. The audio data sets transmitted from the controller 52 can take the form of analog audio signals or, preferably, digital audio signals. If digital, the transmission can be streaming audio signals or compressed audio signals.

The audio data can also be in a surround-sound format if the speakers 23 (FIGS. 1-2) are spatially arranged to deliver this type of broadcasting.

The various formats for the audio data sets and speaker arrangements that can be used by all of the embodiments of FIGS. 1-5 of the present invention are described in detail in U.S. patent application Ser. No. 10/345,787, filed Jan. 16, 2003 and entitled "Gaming System With Surround Sound," being owned by the assignee of the present application, which is herein incorporated by reference in its entirety.

Figure 4:
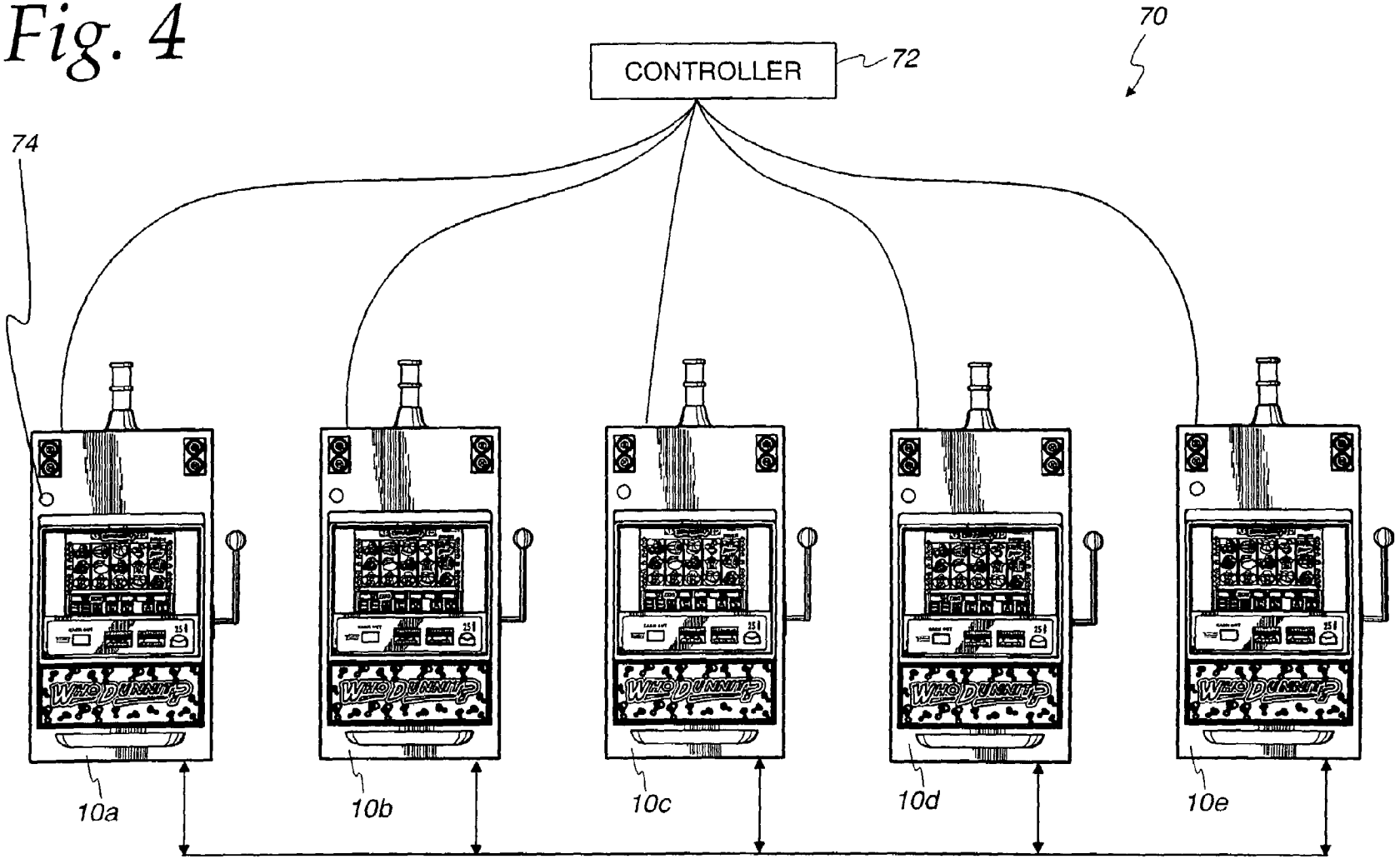
FIG. 4 illustrates an alternative gaming system architecture in which a bank of gaming machines are connected to each other and to a central controller.

FIG. 4 illustrates an alternative system architecture 70 that is different from FIG. 3 in two respects. First, the gaming machines 10*a*-10*e* are all interconnected to each other, in addition to be coupled to a central controller 72. And second, each of the gaming machines 10*a*-10*e* has a microphone 74 that is capable of receiving audio input from players of the gaming machines 10*a*-10*e*.

The system architecture 70 allows one of the gaming machines 10*a*-10*e* to be the master that provides audio instructions to the remaining gaming machines 10*a*-10*e*. As an example, the gaming machine 10*a* may be the master that controls the audio output of the other gaming machines 10*b*-10*e* (i.e., the slaves). As with previous embodiments, the audio instructions from gaming machine 10*a* may be in the form of instructions that selectively cause certain gaming machines 10*b*-10*e* to broadcast certain audio outputs that are derived from audio data sets stored in memory devices in each of those machines 10*b*-10*e*. Or, the master gaming machine 10*a* may be provided with an enhanced audio control system with additional memory that causes it to send streaming audio data or compressed audio data to each of the other gaming machines 10*b*-10*e*.

In the embodiment of FIG. 4, the central controller 72 is optional, but has been illustrated because it may provide more enhanced control of the audio output (and/or game functions) of the gaming machines 10*a*-10*e*. For example, the central controller 72 can be used to connect the bank of gaming machines 10*a*-10*e* to another bank of gaming machines in the vicinity to ensure that that there is no conflicting of audio outputs between the banks (e.g., ensuring that loud broadcasts of positive outcomes do not occur simultaneously between adjacent banks). Or, the controller 72 may provide the enhanced memory for storing a larger database of audio data sets that are selectively transmitted to the gaming machines 10*b*-10*e* under the control of the master gaming machines 10*a*.

The microphones 74 on each of the gaming machines 10*a*-10*e* provide the opportunity for an additional source of audio data to be broadcast from one or more of the gaming machines 10*a*-10*e*. As one example, if a winning outcome of $2000 is achieved in gaming machine 10*a*, the gaming machine 10*a* may broadcast a brief portion of James Brown's song "I Feel Good" and then send an audio message to the player stating, "That was awesome! How do you feel about being $2000 richer?" Presumably, the player may respond with an emphatic "I feel good!!" The player's words (i.e., acoustic signals) are then received via the microphone 74 (i.e., converted from acoustic signals to player-specific audio signals) and processed by the gaming machine 10*a* or central controller 72. The gaming machine 10*a* can then begin broadcasting a modified version of James Brown's "I Feel Good" with the player's own voice dubbed into the song. Further, the other gaming machines 10*b*-10*e* can receive audio instructions from the gaming machine 10*a* (or the central controller 72) and broadcast the dubbed version of James Brown's "I Feel Good" in the winning player's voice.

Alternatively, instead of prompting the player, the microphone 74 on one of the gaming machines 10*a*-10*e* may receive various audible statements from a certain player after achieving a winning outcome. The audio data corresponding to the player's statements can then be synthesized with a voice synthesizer and replayed back to the player from the speakers after the next winning outcome. This same synthesized "parroting" can be done for negative outcomes too. In short, the microphones 74 provide an additional manner for achieving enhanced entertainment at the gaming machines 10*a*-10*e*.

Additionally, the present invention contemplates the use of player tracking cards (or other player-tracking concepts) in the gaming machines to determine the sound preferences of the player. For example, the player may simply want no audio output whatsoever. Or, knowing certain preferences, the type of audio output can be tailored to suit the player's desires based on the gaming machine or the central controller knowing information about the player.

Further, using player tracking with the present invention provides for additional functions that enhance entertainment. By having a "buddy list" on the player tracking card, the audio output associated with a winning outcome can be delivered by the central controller (or master gaming machine) to the gaming machines at which the winning player's buddies are playing, informing them of a certain winning outcome. The audio output at the buddies' gaming machines may be in the form of music, and can be accompanied by a message indicating that winning outcome, such as "Your buddy, Julio, just won $500." Even further, in response to a winning outcome, the microphone 74 (FIG. 4) can allow the winning player to record a message (i.e., an audio output) that will be sent to the player's buddies listed on his player tracking card. For example, after achieving a certain type of outcome, the gaming machine can instruct the player to enter a message via the microphone 74 that will be broadcasted to his or her buddies. The player may state, "I'm buying dinner tonight!!", which is then transmitted to the buddies' gaming machines and broadcast in the voice of the winning player.

Figure 5:
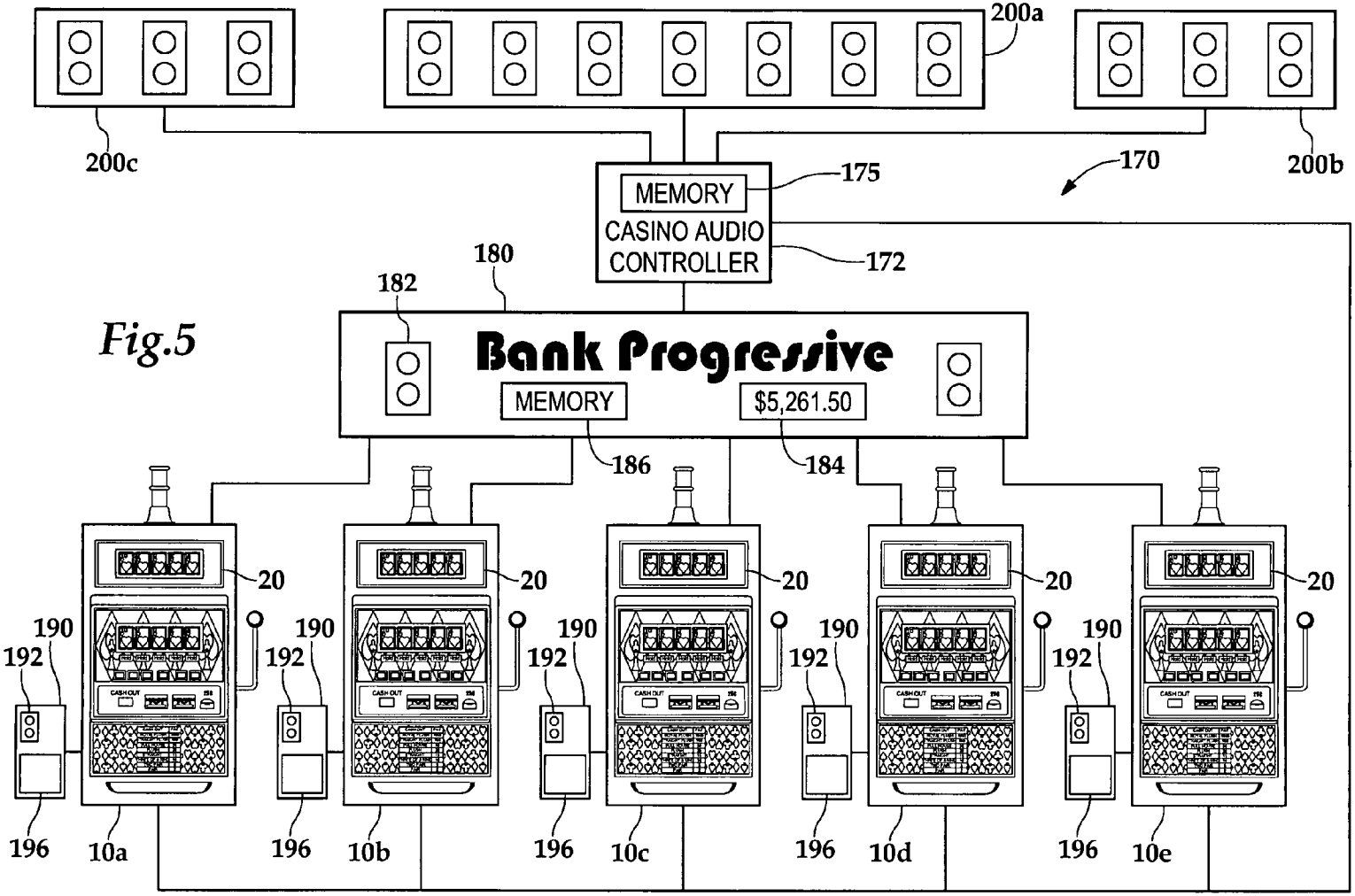
FIG. 5 illustrates a further alternative gaming system architecture including a bank of gaming machines that have peripheral devices, a central controller, and signage.

FIG. 5 illustrates an alternative gaming network 170 by which enhanced audio can be broadcast by the speakers 23 (FIG. 1) within the gaming machines 10, as well as speakers located and other locations. The network 170 can utilize the various types of audio data transmission and audio broadcast discussed with respect to FIGS. 1-4. The network 170 includes a casino audio controller 172 (hereinafter the "central controller") which includes a memory device 175. The central controller 170 is directly coupled to signage 180 that is located proximate to a plurality of gaming terminals 10. Additionally, the central controller 170 is directly coupled to the gaming terminals 10, and indirectly coupled to them via the signage 180.

The signage 180 includes its own audio speaker system 182 and a display 184 and that provides information about a wagering game. As shown, the signage 180 relates to a progressive game and the display 184 is providing information concerning the value of the progressive jackpot. Alternatively, the signage 180 may simply be for advertising or to attract players to the bank of gaming machines 10. The signage 180 includes a memory device 186 that allows for audio files to be stored within the signage 180.

In the embodiment shown in FIG. 5, each of the gaming machines 10 includes the memory device 20 (see FIG. 2) for storing audio files. Further, each of the gaming machines 10 is electronically coupled to a peripheral device 190. The peripheral device 190 includes a speaker system 192 and a memory device 196 for storing audio data files. The peripheral device 190 can be a top box that is located above the gaming machine 10. Such a top box may be used for displaying information concerning a bonus game or a progressive game. Alternatively, the peripheral device 190 can be a chair in which the player sits as he or she is playing a wagering game at the gaming machine 10. One such chair is disclosed in U.S. Provisional Application No. 60/592,894, entitled "Gaming Machine Chair" to Canterbury et al, filed on Jul. 30, 2004, and being owned by the assignee of the present application, which is herein incorporated by reference in its entirety.

The central controller 172 of the network 170 is also coupled to the overall sound system of the casino, which has sets of remotely located speakers 200*a*, 200*b*, and 200*c*. Consequently, the central controller 172 can be used to selectively control the speakers 23 in the gaming machine 10 (see FIG. 1), the speakers 182 in the signage 180, the speakers 192 in the peripheral device 190, and the sets of remotely located casino speakers 200*a*, 200*b*, and 200*c*.

The network 170 of FIG. 5 can be used in a variety of ways, some of which do not require the use of each of the memory devices 20, 175, 186, and 196. As an example, the memory device 175 within the central controller 172 can store all of the audio data files that are necessary to broadcast audio from the various speaker systems 23, 182, 192, and 200. In response to a predetermined time, or an event (such as a winning outcome being achieved at one of the gaming terminals 10), the central controller 172 can transmit audio files to the various speaker systems 23, 182, 192, and 200 such that they all play the same message or music, or such that different audio is played at each of the speaker systems 23, 182, 192, and 200. Thus, the controller 172 can produce choreographed audio effects throughout the casino through the sequential broadcasting of different audio at the speaker systems 23, 182, 192, and 200. In yet a further alternative, each of the memory devices 20, 175, 186, and 196 is included within the network 170 and the central controller 172 simply transmits high-level signals instructing the various components to select certain data files from their associated memory devices 20, 175, 186, and 196 to result in a certain audio broadcast throughout the casino.

Instead of the controller 172 being the originator of the signal to cause the same (or different) audio to be broadcasted from the various speaker systems 23, 182, 192, and 200, the signage 180 may include a controller that determines when a certain audio broadcast should be broadcast. This may occur, for example, when a certain winning outcome (progressive winning outcome) is achieved, or when the progressive jackpot reaches a certain level. In this situation, the signage 180 can instruct the central controller 172 to transmit and disseminate audio instructions to the various speaker systems 23, 182, 192, and 200. Alternatively, the signage 180 can send data files from its memory device 186 to each of the participating gaming machines 10 so that the proper audio can be broadcast from the speakers 23 (FIG. 1) in the gaming machines 10 and/or from the speakers 192 in the peripheral device 190. In a further alternative, the signage 180 can send high-level signals to the participating gaming machines 10, and each of the gaming machines 10 relies upon the audio data files stored in the memory device 20 or 196 to result in the desired audio output. The signage 180 may also send instructions to the central controller 172 for broadcasting a certain audio from the sets of remotely located casino speakers 200, or the signage 180 can be directly coupled to and drive the sets of remotely located casino speakers 200.

Similarly, one of the gaming machines 10 can be the originator of the signal that causes the audio broadcast. For example, the gaming machine 10*c* can encounter a certain event, such as a certain winning outcome, that causes the signal to be transmitted to the adjacent gaming machines 10*b* and 10*d*. The signal may be in the form of a high-level instruction, that is sent from the gaming machine 10*c* or its peripheral device 190 instructing the adjacent gaming machines 10*b* and 10*d* to select a certain audio file in the memory 20 or the memory 196 of their peripheral devices 190. This methodology results in a certain audio output from the speakers 192 in the chairs (i.e., peripheral device 190) of adjacent gaming machines 10*b* and 10*d* and/or the speakers 23 of the gaming machines 10*b* and 10*d* to create localized excitement. Alternatively, the signal from the gaming machine 10*c* may be in the form of an audio file stored in the memory 20 or the memory 196 for transmission to the adjacent gaming machines 10*b* and 10*d*. Likewise, the gaming machine 10*c* may send audio instructions to the signage 180 for instructing a broadcast from the audio speakers 182, or to the central controller 172 for instructing a broadcast from the sets of remotely located casino speakers 200. In summary, the peripheral device 190 of the gaming machine 10*c*, or the gaming machine 10*c* itself, may cause an audio instruction to be sent to other gaming machines 10, the signage 180, or the casino central controller 170.

One of the benefits of having a memory device 196 or 20 with specific audio files stored therein is that the gaming machines 10*a*-10*e* may be of different types having different themes and, hence, different associated audio elements. By permitting transmission of audio files to adjacent gaming machines 10 or their peripheral devices 190, or the signage 180, the types of audio broadcasts can be unique. For example, when several differently themed gaming machines 10*a*-10*e* are competing for the same progressive jackpot, the gaming machine 10 that wins may cause its themed celebratory music to be played so that all players know which type of gaming machine 10 won the progressive jackpot.

In addition, it should be noted that the network 170 allows for the selective broadcasts to only specific ones of the gaming machines 10. This can be done by knowledge of the identification of the player at the gaming machines 10. For example, a player membership card that is inserted into the gaming machines 10 may result in such an identification. Or, players that are wagering together or adverse to each other in the form of teams may receive enhanced audio that is specific to the team-wagering game Yet further, players that are wagering at certain heightened levels can receive enhanced audio. Or, players who are competing for a certain prize (e.g., those playing the progressive game in the display 184 of the signage 182) can achieve enhanced and selective audio associated with the progressive game.

While the present invention has been described with reference to one or more particular embodiments, those skilled in the art will recognize that many changes may be made thereto without departing from the spirit and scope of the present invention. For example, beyond the streaming audio data mentioned above, the audio signals can be produced from a live feed, such as a live announcer or a live band. Further, the gaming machines may be equipped to deliver the audio output to headphones (wired or wireless) that the player is wearing. Each of these embodiments and obvious variations thereof is contemplated as falling within the spirit and scope of the claimed invention, which is set forth in the following claims.

What is claimed is:

1. A gaming machine network, comprising:

a plurality of gaming machines, each gaming machine of said plurality of gaming machines including a gaming cabinet having a display for displaying a randomly selected outcome selected from a plurality of outcomes in response to a wager input, each gaming machine including an associated peripheral device electronically coupled to said gaming machine, each peripheral device being physically distinct from said gaming cabinet and including an audio speaker system for broadcasting an audio output to a player of said gaming machine;

casino speakers located remotely from and physically separate from said plurality of gaming machines and said peripheral devices; and a central controller electronically coupled to each of said plurality of gaming machines and said casino speakers, said central controller sending audio instructions controlling said audio outputs of said audio speaker systems within said peripheral devices of said plurality of gaming machines and controlling said casino speakers.

2. The gaming network of claim 1, wherein said audio instructions include audio data in a digital audio format.

3. The gaming network of claim 1, wherein said audio instructions include audio data in a digital surround-sound format.

4. The gaming network of claim 1, wherein said central controller sends said audio instructions in response to real time being a predetermined time.

5. The gaming network of claim 1, wherein said central controller selectively sends said audio instructions to certain ones of said plurality of gaming machines.

6. The gaming network of claim 5, wherein said audio instructions that are sent to said certain ones of said plurality of gaming machines are different.

7. The gaming network of claim 5, wherein said certain ones of said plurality of gaming machines are selected based on an identification of players playing at said certain ones of said plurality of gaming machines.

8. The gaming network of claim 1, wherein audio instructions include compressed audio data.

9. The gaming network of claim 8, wherein each of said peripheral devices include a digital-to-analog converter and a power amplifier for processing said compressed audio data so as to broadcast said audio output.

10. The gaming network of claim 1, wherein said central controller selectively sends said audio instructions to a certain one of said plurality of gaming machines, said audio instructions corresponding to an audio output that contains a message for a player of said certain one of said plurality of gaming machines.

11. The gaming network of claim 10, wherein said message relates to an outcome achieved by said gaming machine.

12. The gaming network of claim 11, wherein said message includes music having lyrics that relate to said outcome.

13. The gaming network of claim 1, wherein said central controller selectively sends said audio instructions to each of said plurality of gaming machines in response to one of said gaming machines achieving a certain outcome.

14. The gaming network of claim 13, wherein said audio instructions sent to one of said plurality of gaming machines is different from said audio instructions sent to others of said plurality of gaming machines.

15. The gaming network of claim 13, wherein said audio instructions include music.

16. The gaming network of claim 1, wherein said peripheral devices are top boxes located above said gaming machines for displaying information about a bonus game or a progressive game.

17. The gaming network of claim 16, wherein said audio instructions relate to said bonus game or said progressive game.

18. The gaming network of claim 17, wherein said audio instructions provide choreographed audio effects broadcasting from said audio speaker systems, said choreographed audio effects include sequential actuation of said audio speaker systems of said peripheral devices.

19. The gaming network of claim 1, wherein said audio speaker system includes one speaker.

20. The gaming network of claim 1, wherein said central controller selectively sends said audio instructions to each of said plurality of gaming machines in response to a randomly selected event or time.

21. The gaming network of claim 1, wherein said audio speaker system of each of said peripheral devices includes a plurality of speakers in a non-planer spatial arrangement around a location where a player is positioned at said respective gaming machines.

22. The gaming network of claim 1, wherein each of said peripheral devices includes memory for storing audio data sets and, in response to receiving said audio instructions from said central controller, one of said audio data sets is selected for broadcasting through said audio speaker system.

23. The gaming network of claim 22, wherein a processor within each of said plurality of gaming machines selects said one of said audio data sets from said memory.

24. The gaming network of claim 1, wherein said central controller also sends said audio instructions to signage speakers on signage proximate to said plurality of gaming machines, said signage displays information about a bonus game or a progressive game.

25. The gaming network of claim 1, wherein at least one of said plurality of gaming machines includes a microphone for converting acoustic signals from a player to player-specific audio signals.

26. The gaming network of claim 25, wherein said player-specific audio signals are processed and broadcasted as an audio output from said audio speaker systems within said peripheral devices.

27. The gaming network of claim 1, wherein said peripheral devices are chairs in which players of said gaming machines are seated while playing said gaming machines.

28. The gaming network of claim 27, wherein said audio speaker system in said chair includes a plurality of speakers in a non-planer spatial arrangement around a location where said player is sitting at said gaming machine.

29. The gaming network of claim 1, wherein said central controller is also for receiving other audio instructions from one of said peripheral devices and disseminating said other audio instructions to selected other ones of said plurality of gaming machines.

30. A gaming machine network, comprising:

a plurality of gaming machines having different themes, each gaming machine of said plurality of gaming machines including a gaming cabinet that includes a display for displaying a randomly selected outcome from a plurality of outcomes in response to a wager input, each gaming machine including an associated peripheral device electronically coupled to said gaming machine, each peripheral device being physically distinct from said gaming cabinet and including an audio speaker system broadcasting an audio output to a player of said gaming machine and a memory device containing audio files, said audio files in different ones of said memory devices being different and associated with said different themes for said associated gaming machines; and a central controller electronically coupled to each of said plurality of gaming machines, said central controller receiving audio instructions from one of said peripheral devices and disseminating said audio instructions to selected other ones of said plurality of gaming machines, said audio instructions disseminated by said central controller include one or more of said audio files such that at least one of said selected other ones of said gaming machines broadcasts an audio output that is associated with a theme that is different from a theme of said at least one of said selected other ones of said gaming machines.

31. The gaming network of claim 30, wherein said peripheral devices are chairs in which players of said gaming machines are seated while playing said gaming machines.

32. The gaming network of claim 31, wherein said audio speaker system in said chair includes a plurality of speakers in a non-planer spatial arrangement around a location where said player is sifting at said gaming machine.

33. The gaming network of claim 31, wherein said memory device is located within said chair.

34. The gaming network of claim 31, wherein said audio files are sent to said central controller in a compressed audio data format.

35. The gaming network of claim 31, wherein said peripheral devices are top boxes located above said gaming machines for displaying information about a bonus game or a progressive game.

36. The gaming network of claim 35, wherein said audio instructions relate to said bonus game or said progressive game.

37. The gaming network of claim 31, wherein said selected ones of said plurality of gaming machines are selected based on an identification of players playing at said plurality of gaming machines.

38. A gaming machine network, comprising:

a plurality of gaming machines, each gaming machine of said plurality of gaming machines including a display for displaying a randomly selected outcome from a plurality of outcomes in response to a wager input, each of said plurality of gaming machines including gaming machine speakers for producing gaming-machine audio output;

signage located proximate to and being physically distinct from said gaming machines, said signage displays information about a bonus game or a progressive game and being electronically coupled to said gaming machines, said signage including a memory device containing audio files and an audio speaker system broadcasting signage audio output to players of said gaming machines; and a central controller electronically coupled to each of said plurality of gaming machines and said signage, said central controller receiving audio instructions from one of said plurality of gaming machines, and wherein in response to receiving said audio instructions from said one of said plurality of gaming machines, said central controller controlling said signage audio output of said signage and said gaming-machine audio output of other ones of said gaming machines, said signage using said audio files in said memory device for developing said signage audio output.

39. The gaming network of claim 38, wherein said information is a monetary value associated with an award in said bonus game or said progressive game.

40. The gaming network of claim 38, wherein a processor within each of said plurality of gaming machines selects said audio instructions to be sent to said central controller.

41. A gaming machine network, comprising:

a plurality of gaming machines, each gaming machine of said plurality of gaming machines including a display for displaying a randomly selected outcome selected from a plurality of outcomes in response to a wager;

signage located proximate to and being physically distinct from said plurality of gaming machines, said signage displays information about a bonus game or a progressive game and being electronically coupled to said gaming machines, said signage including a memory device containing audio files and an audio speaker system broadcasting an audio output to players of said gaming machines; and a central controller electronically coupled to each of said plurality of gaming machines and said signage, said central controller transmitting audio instructions to selected ones of said plurality of gaming machines and to said signage in response to the occurrence of a certain event at one of said gaming machines.

42. The gaming network of claim 41, wherein said audio instructions sent by said central controller include one or more of said audio files.

43. The gaming network of claim 42, wherein said audio files are sent by said central controller in a compressed audio data format.

44. The gaming network of claim 41, wherein said audio instructions sent by said central controller include instructions to select a certain audio file stored in memories within said plurality of gaming machines and to select certain audio files stored in said memory device within said signage.

45. The gaming network of claim 41, wherein said selected ones of said plurality of gaming machines are selected based on an identification of players playing at said certain ones of said plurality of gaming machines.

46. The gaming network of claim 41, wherein said information is a monetary value associated with an award in said bonus game or said progressive game.

47. The gaming network of claim 41, wherein said event is a winning outcome that is achieved at one of said plurality of gaming machines.

48. The gaming network of claim 41, wherein said central controller sends audio instructions to said signage in response to the real time being a predetermined time.

49. A method of operating a gaming system including a plurality of linked gaming machines, a central controller, and signage that is physically distinct from said plurality of gaming machines, each of said gaming machines including an associated peripheral device electronically coupled thereto and physically distinct from said gaming machine, said signage displaying information about a bonus game or a progressive game, said central controller being linked to said plurality of gaming machines and to said signage, said method comprising:

receiving wager inputs from players at said plurality of linked gaming machines;

in response to a certain event, instructing said peripheral devices via said central controller to broadcast an audio output from audio speaker systems located within said peripheral devices, said instructing including accessing a desired audio file in a memory device located within said peripheral devices, in response to said certain event, instructing said signage, via said central controller, to broadcast a signage audio output from an audio speaker system located within said signage; and broadcasting said audio output from said one of said peripheral devices and said signage audio output from said signage.

50. The method of claim 49, further including instructing all of said linked gaming machines to access a desired common audio file stored in memory devices located within said peripheral devices.

51. The method of claim 49, wherein said instructing causes certain ones of said linked gaming machines to access different audio files stored in memory devices located within said peripheral devices, said audio output being different for said certain ones of said plurality of gaming machines.

52. The method of claim 49, further including instructing remotely located casino audio speakers, via said central controller, to broadcast a desired audio output in response to said certain event.

53. The method of claim 49, wherein said certain event is a winning outcome at said one of said plurality of said gaming machines.

54. The method of claim 49, wherein said information is a monetary value associated with an award in said bonus game or said progressive game.

55. The method of claim 49, wherein said peripheral device are chairs in which players of said gaming machines are seated while playing said gaming machines.

56. The method of claim 49, wherein said peripheral devices are top boxes located above said gaming machines for displaying information about a bonus game or a progressive game.

* * * * *

UNITED STATES PATENT AND TRADEMARK OFFICE

CERTIFICATE OF CORRECTION

PATENT NO. : 7,479,063 B2
APPLICATION NO. : 10/955664
DATED : January 20, 2009
INVENTOR(S) : Eric M. Pryzby et al.

It is certified that error appears in the above-identified patent and that said Letters Patent is hereby corrected as shown below:

In Column 13, Claim 32, please replace Lines 13-16 with the following:

-- 32. The gaming network of claim 31, wherein said audio speaker system in said chair includes a plurality of speakers in a non-planer spatial arrangement around a location where said player is sitting at said gaming machine. --

Signed and Sealed this

Seventeenth Day of March, 2009

John Doll

JOHN DOLL
*Acting Director of the United States Patent and Trademark Office*